United States Patent [19]

Davis

[11] 4,311,872

[45] Jan. 19, 1982

[54] PORTABLE VOICE COMMUNICATION SYSTEM

[76] Inventor: Robert P. Davis, 3250 Waverly Dr., Los Angeles, Calif. 90027

[21] Appl. No.: 40,804

[22] Filed: May 21, 1979

[51] Int. Cl.[3] ..... H04R 1/44

[52] U.S. Cl. ..... 179/1 R; 179/1 A; 179/179; 330/294

[58] Field of Search ..... 179/1 R, 1 A, 1 UW, 179/1 VC, 110 C, 110 E, 110 A, 146 R, 179, 180; 330/107, 109, 294; 181/179, 181, 182, 198, 207

[56] References Cited

U.S. PATENT DOCUMENTS

| | | | |
|---|---|---|---|
| 3,382,321 | 5/1968 | Lybarger et al. | 179/1 A |
| 3,422,225 | 1/1969 | Griese | 179/1 A |
| 3,588,359 | 6/1971 | Cribb | 179/1 R |
| 3,732,446 | 5/1973 | Bryant | 179/110 A |

FOREIGN PATENT DOCUMENTS

| | | | |
|---|---|---|---|
| 869895 | 6/1961 | United Kingdom | 179/1 R |

*Primary Examiner*—Bernard Konick
*Assistant Examiner*—J. A. Popek
*Attorney, Agent, or Firm*—Nilsson, Robbins, Dalgarn, Berliner, Carson & Wurst

[57] ABSTRACT

A throat microphone consists of a dynamic pressure transducer sealed within an airtight tympanic enclosure to be held by an elastic band on the user's throat near the voice box. The electrical signals generated by the transducer are applied as an input signal to an amplifier and speaker unit where the signal is conditioned by a preamplifier stage for further amplification by a second stage that contains a variable reactive negative feedback network that acts as a low pass filter and corrects the phase shift of the different lower frequency audio signal components while emphasizing the higher frequency components so that severe phase distortion of the signal applied to the drive speaker through an output power amplifier stage can be minimized to make the speech sounds reproduced more intelligible.

12 Claims, 4 Drawing Figures

FIG. 1
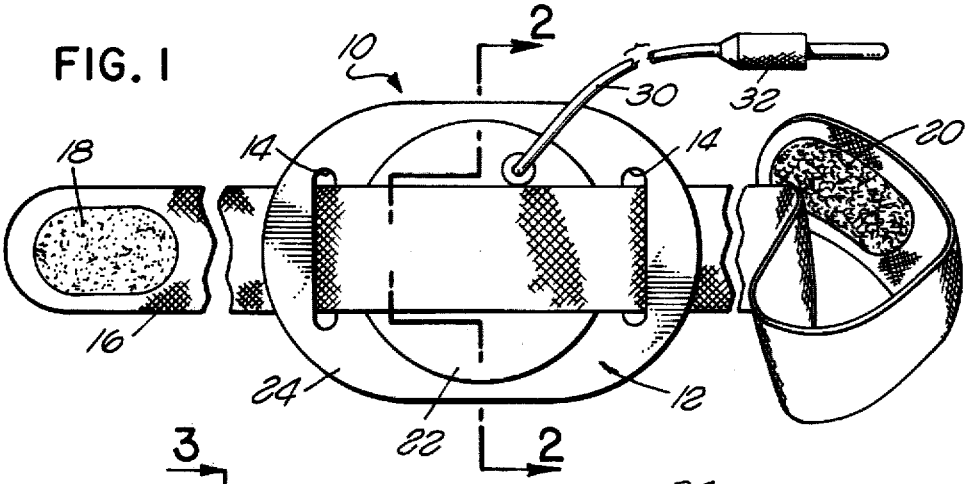
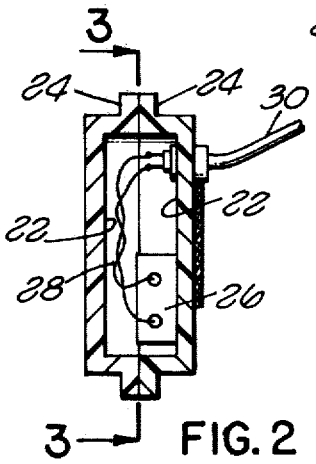
FIG. 2
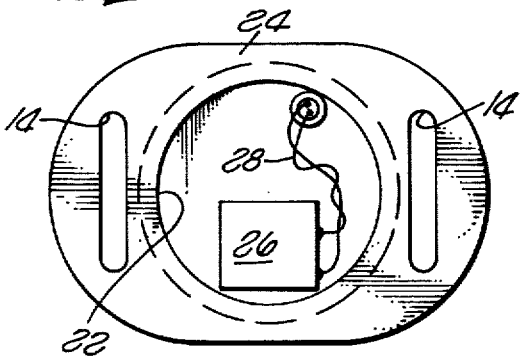
FIG. 3
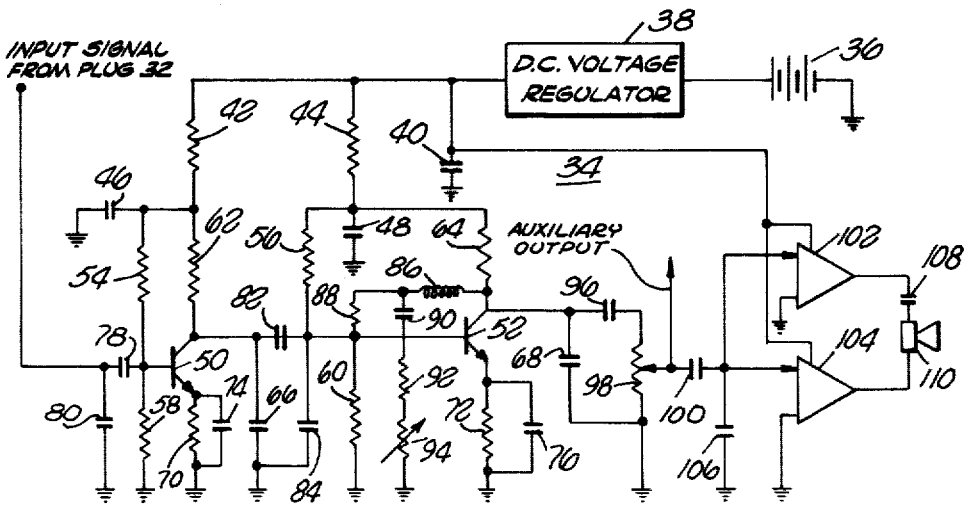
FIG. 4

PORTABLE VOICE COMMUNICATION SYSTEM

BACKGROUND OF THE INVENTION

1. Field of the Invention

The invention relates to portable voice communications systems for establishing direct voice contact between individuals wearing air breathing equipment with face masks.

2. Background of the Invention

Firemen and other emergency personnel, as well as workers in certain industries, are often required to wear protective air breathing apparatus or masks to avoid the toxic effects of noxious gases, smoke, chemical fumes, vapors and airborne particulate matter. The mask or other breathing apparatus covering the mouth and nose severely attenuates unaided speech and makes vocal communication with other individuals most difficult, if not impossible, particularly where an airtight seal must be maintained.

In the past, systems have been devised to place small conventional microphones within the mask or other breathing apparatus to generate an electrical signal that can be amplified to drive a small speaker unit worn by the individual. However, such prior systems have not been satisfactory for several reasons. To begin with, the breathing apparatus or mask provides an irregularly shaped confined space that distorts the wearer's voice patterns with unpredictable reverberation, resonance and reflection effects that depend upon the shape of the mask relative to the covered area of the user's face. As a consequence, the signal produced by the microphone and amplified to drive the speaker produces a garbled speech pattern that lacks clarity and is frequently inaudible to the untrained listener. In addition, wires connecting the microphone inside the amplifier and loudspeaker unit must pass through the mask which can inherently compromise the integrity of the airtight seal required pursuant to various safety regulations, and with extended or vigorous use may actually be pulled loose.

These problems are further aggravated by the limitations of the sound amplification and speaker units which, with their self contained power sources, must be relatively small and lightweight so that users can carry them without unduly hampering their movements or interferring with their ability to handle tools and other emergency equipment. Accordingly, the quality and volume of the speech sound reproduced by the speaker is often less than adequate, especially in industrial and emergency environments where background noise is high. The natural tendency of most people to talk louder or to shout to make themselves understood only increases sound distortions due to reverberation, resonance and reflection within the mask and also often overloads the low power amplifier beyond its undistorted dynamic range limits to introduce further distortion.

Throat microphones have long been used previously, especially by crews in unpressurized aircraft for voice communication at higher altitudes where oxygen masks are worn. Although this avoids the problems due to placing a microphone within the mask, throat microphone systems are subject to other difficulties that have impaired their successful use in portable voice communication systems. Generally throat microphones primarily respond to the lower frequency components of normal speech. However with conventional amplifying methods severe distortion due to the sizable phase shift differences between different low frequency components occur. Thus untrained listeners often have difficulty understanding speech reproduced from throat microphone systems and thus throat microphone systems have heretofore been deemed inadequate.

SUMMARY OF THE INVENTION

The voice communications system of this invention employs a throat microphone assembly connected to a lightweight amplifier and speaker unit powered by normal transistor batteries. The output from the throat microphone is amplified through preamplification, intermediate and power output stages to drive a loudspeaker. The intermediate amplifier stage however incorporates a simple adjustable phase shift and frequency compensation network to minimize the severe phase shift and high frequency attenuation distortions arising from the use of throat microphones.

The phase shift and frequency compensation results from negative feedback supplied from the output of the intermediate amplifier stage to its input through an adjustable reactive network. In the preferred embodiment, the amplifier output is fed back through an inductive element that acts as a high frequency choke to retard negative feedback of high frequency audio components while passing the lower frequencies with a variable phase lag dependent on their frequency. In addition, the feedback signal passing the inductive element is applied across a variable resistor and capacitor connected in series to ground that selectively attenuates higher frequency components to be varied according to the particular frequency content of the speaker's voice.

Most speech sounds are composed of a mixture of different audio frequency components that are determined by the anatomy and acquired speech patterns of each individual. Unfortunately the lower frequencies to which throat microphones are most responsive are more sensitive to phase shift distortion due to capacitive coupling within the amplifier electronics, and the relative phase shift between them depends upon their frequency separation. Although the natural phase relationship between the low frequency components may not be fully restored, a setting of the variable resistor can be chosen to alleviate the more severe phase shift distortions caused by any given individual's speech pattern, while at the same time producing a corresponding enhancement of the undistorted higher frequency components to make the reproduced speech sounds more intelligible.

BRIEF DESCRIPTION OF THE DRAWINGS

FIG. 1 is an elevational view showing the throat microphone and its attached neck strap with portions of the strap intermediate the ends broken away;

FIG. 2 is a cross sectional view of the throat microphone taken along the lines 2—2 of FIG. 1 showing the interior arrangement of the microphone components;

FIG. 3 is a full cross sectional elevational view taken along the line 3—3 of FIG. 2 between the two halves of the throat microphone housing; and, FIG. 4 is a schematic circuit diagram of a preferred form of the electronic amplifier and speaker unit employed with the throat microphone of FIGS. 1-3 in accordance with the invention.

DETAILED DESCRIPTION

Referring now to FIGS. 1 through 3, a throat microphone 10 has an elliptical shaped plastic housing 12 with elongated slits 14 at either end for receiving a flat neck strap 16. Preferrably the strap 16 is composed of woven thread or similar material that has some elasticity to help hold the throat microphone tightly against the user's voice box. An adjustable coupling at the strap ends permits it to be affixed tightly around the user's neck and, as shown, may consist of a patch 18 of material with numerous small plastic hooks, such as that available under the trademark VELCRO, affixed to the strap 16 at one end to engage an elongated felt patch 20 or the like on the opposing surface at its other end so that the strap can be readily adjusted to necks of varying circumference.

In its preferred form, the microphone housing 12 consists of two identical thin walled, vinyl plastic half sections, each having a shallow concave cylindrical center portion 22 surrounded by flat elliptical flanges 24. The halves are joined together with a suitable plastic adhesive or solvent, such as metal ethyl ketone (MEK), applied between the opposing flange surfaces. With the flanges 24 sealed, the opposing cylindrical center portions 22 form an airtight cylindrical enclosure.

Although equivalent small microphone transducers might be used, the preferred embodiment employs a miniature dynamic sound pressure transducer 26 having an inductive coil pickup with a moveable metal core, such as the Knowles models designated BA1501 and 1550, mounted within the enclosure. With the diameter of the cylindrical enclosure about eight tenths of an inch, this tiny transducer 26 is affixed to the interior surface of one of the end walls near the periphery of the cavity radially displaced from its central axis. The axial extent of the enclosure is about one-quarter of an inch, or about twice the thickness of the transducer 26, thus leaving a substantial portion of the interior space unobstructed. In this way, thin plastic walls define a small tympanic or drum-like enclosure to enhance the transducer response. In addition, the phase lag produced by the inductive reactance of the transducer pickup coil offsets to some degree the usual phase lead shift that results from capacitive coupling of the microphone input to the amplifier circuitry.

The pair of wire leads 28 from the transducer output are connected within the enclosure to a terminal at one end of an insulated cable 30 that delivers the transducer output signal to the amplifier and speaker unit that is usually clipped or strapped to the user's waist or other appropriate location. The other end of the cable 30 contains a plug 32 to be inserted into an appropriate input jack receptacle on the amplifier and speaker unit. Both the transducer 26 and the cable terminal are affixed to the same end wall of the cylindrical enclosure that would face outwardly from the user's neck. An adhesive or sealant maintains an airtight seal around the cable terminal where it passes through an aperture in the end wall. The thin flat circular end wall on the other side of the enclosure that is pressed against the user's throat thus vibrates freely over its entire area in response to the voice sounds, so that these are transmitted through the entrapped air within the enclosure to move the armature of the transducer 26. On the other hand, the transducer 26 and the cable terminal mounted on the opposite end wall add significant rigidity and inertia that inhibits its vibration in response to external ambient sound levels, thereby improving the ambient noise rejection properties of the microphone. This is particularly important in many emergency and industrial environments where high ambient noise levels are encountered.

Referring now to FIG. 4, the amplifier and speaker unit 34 for the most part employs a conventional regulated power supply to operate preamplifier, intermediate and output stages to drive a conventional speaker assembly. In its preferred form, a compact, lightweight amplifier and speaker unit 34 employs a primary 36-volt DC power source that may consist of four 9-volt "transistor" type batteries connected in series. This primary voltage supply is coupled through a direct current voltage regulator 38, such as the LM341P24 unit available from National Semiconductor, to operate the amplifier and speaker components. A 220-microfarad smoothing capacitor 40 that couples the voltage regulator output to ground further stabilizes the direct current voltage supply level and acts as a decoupler to minimize positive audio signal feedback through the power supply circuitry. The stabilized voltage regulator output is coupled through a pair of 2.7-kiloohm dropping resistors 42 and 44 to reduce the 24-volt regulator output to an 8-volt B+ supply for the pre-amplifier and intermediate amplifier stages, and individual 33-microfarad capacitors 46 and 48 connected to ground provide further smoothing and audio feedback decoupling of this B+ supply to each stage at the low voltage end of the respective dropping resistors 42 and 44.

In the actual unit described herein, both the preamplifier and intermediate amplifier stages employ the same type NPN transistor elements 50 and 52, respectively, such as a 2N3904. The base of each transistor 50 and 52 receives a positive direct current bias of about 1-volt with respect to ground that is supplied from a voltage divider at the junction between a 36-kiloohm resistor 54 or 56 connected in series to ground with a respective 6.8-kiloohm resistor 58 or 60. The B+ supply for both transistors 50 and 52 are applied through separate 1.5-kiloohm load resistors 62 and 64, to develop the output signal for the stage that is then coupled to ground through its 0.05-microfarad shunting capacitor 66 or 68 which dissipate any radio frequency pickup and provide additional high frequency decoupling to minimize oscillation tendencies. The emitters of both transistors 50 and 52 are connected through small 100-ohm stabilizing resistors 70 and 72 that tend to reverse bias the emitter base junction as collector current increases for protection against thermal runaway, and a 22-microfarad emitter bypass capacitor 74 or 76 is coupled across these emitter resistors to dissipate alternating current signals, thus preventing significant negative feedback.

The preamplifier stage receives the audio input signal from the throat microphone transducer 26 from the cable terminal plug 32 to be fed through a 10-microfarad input blocking capacitor 78 that prevents direct current from the transistor base biasing network from reaching the transducer coil windings. A 0.01-microfarad rf bypass capacitor 80 couples the input to ground to eliminate high frequency ambient pickups. Similarly the amplifier audio signal output from the collector terminal of the first stage transistor 50 is applied through a 4.7-microfarad interstage coupling capacitor 82 that maintains direct current isolation, and a 0.01-microfarad rf bypass capacitor 84 provides high frequency decoupling between stages to minimize oscillation tendencies and dissipate any rf pickup in the input signal applied to the base terminal of the second stage transistor 52.

Unlike the first stage, the second stage has a variable reactive negative feedback network with variable reactance for adjusting the phase of the lower frequency audio signal components and selectively emphasizing the higher audio frequencies. In the preferred embodiment, the reactive negative feedback network employs a 150-millihenry inductance coil 86 that is connected to the collector output terminal of the second stage transistor 52 in series with a 12-kiloohm feedback resistor that couples the second stage output to the base terminal input. The feedback signal that passes through the coil 86 is bypassed to ground through a 0.22-microfarad capacitor 90 connected in series with a 1-kiloohm fixed resistor 92 and 50-kiloohm variable resistor 94 which act together to reduce the Q of the series LC combination of the coil 86 and capacitor 90. Thus the fixed resistor 92 serves to prevent regenerative oscillation should the variable resistor be at or near zero resistance.

In operation, the values for the inductance coil 86 and the capacitor 90 establish the basic phase shift and frequency response characteristics of the feedback loop, whereas the variable resistor 94 is used to vary the phase shift of the feedback loop while also acting as a tone control in establishing the amplitude of the high frequency audio signal components being fed back that would otherwise be shunted to ground through the capacitor 90. Specifically, increasing the resistance of the variable resistor 94 results in more negative feedback of the higher frequency audio components, thereby decreasing their overall amplification relative to lower frequencies. At the same time, changes in this variable resistance varies the relative phase shift between the lower frequency components of the negative feedback signal so that any severe phase shift distortion between these components can be alleviated. The reactive network thus acts as a variable low pass filter to alter the phase of the lower frequency components most subject to phase shift distortion, while emphasizing the higher frequencies that are relatively immune to phase shift distortion.

The output of the second stage from the collector terminal of the transistor 52 is applied through a 10-microfarad coupling capacitor 96 that provides direct current isolation of the second stage from the remaining output circuitry. The output signal is developed across a 100-kiloohm output potentiometer 98 with its tap serving as a volume control to vary the amplitude of the available output. The potentiometer tap may also be connected to an auxiliary external output jack to allow the amplified audio output to be applied to some external amplifier system, such as an intercom or radio transmitter. In addition, the external jack can be provided with an automatic switch feature that disconnects the internal output stage.

The input to the power output stage is applied through a 47-microfarad coupling capacitor 100 that provides direct current isolation from the potentiometer 98 to the inputs of a pair of power amplifier circuits 102 and 104 connected in a push-pull configuration that effectively doubles the undistorted output available. In the preferred unit, the power amplifiers consists of LM384 linear integrated circuits that receive full operating power of 24-volts directly from the output of the direct current voltage regulator 38. A 0.005-microfarad bypass capacitor 106 connects the inputs of these amplifiers to ground to eliminate radio frequency pickups. The push-pull output from the amplifiers 102 and 104 are connected through a 220-microfarad output capacitor 108 to opposite terminals of a conventional small size speaker 110 that a provides a peak voice power output of 3-watts or more to provide intelligible voice communication over 75-feet or more.

With the preferred embodiment using circuit components specified herein, the entire unit, including its power supply batteries, weighs less than one pound, and the amplifier and speaker unit with its protective case is only about five and a half inches long, three and a half inches wide and one inch thick. Accordingly, through use of the improved throat microphone combined with the relatively simple phase shift compensation network within the amplification circuitry, the system in accordance with this invention is able to provide a significantly better quality of voice communication than available heretofore between individuals in emergency and industrial situations requiring the use of breathing masks.

Although the invention has been described in relation to a preferred embodiment corresponding to the actual system currently produced, it should be understood that various changes and modifications may be made in the components and their arrangement in relationship to one another, without departing from the spirit and scope of the invention as defined in the appended claims.

What is claimed is:

1. An improved portable voice communication system comprising:

a throat microphone assembly attachable on the neck of a user near the voice box to generate electrical signals in the audio frequency range in response to the user's voice;

a speaker unit for reproducing voice sounds corresponding to an amplified form of the electrical signals generated by the throat microphone; and, an amplifier unit for amplifying the electrical signals generated by the throat microphone to drive said speaker unit and containing a frequency variable phase shift network for adjusting the phase between lower frequency audio components being amplified to alleviate severe phase shift distortions in the amplified audio signals for driving the speaker to reproduce the voice sounds of the user.

2. The portable voice communication system of claim 1 wherein:

the amplifier with the frequency variable phase shift network consists of a negative feedback network that operates as a low pass filter to selectively increase the amplification of higher frequency audio signals while decreasing the amplification of lower frequencies.

3. The portable voice communication system of claim 2 wherein:

said variable phase shift network consists of a negative feedback signal path through an inductive reactance element between the output of one amplifier stage and its input and a variable capacitive network for selectively attenuating the higher frequency components of the negative feedback passed by said inductive reactance element to the input of said amplifier stage.

4. The voice communication system of claim 3 wherein:

said variable capacitive network comprises a fixed capacitor connected in series with a variable resistance across the input terminals to said amplifier stage, whereby the inductive element acts in series with the fixed capacitor and said variable resistor to form a low pass LC negative feedback network having a variable Q.

5. The voice communication system of claim 4 wherein:

said amplifier includes a preamplifier stage for receiving the electrical signals from said microphone to provide an amplified audio signal to said one amplifier stage, and a power output amplifier stage coupled to drive said speaker in response to the output from said one amplifier stage, and having capacitive coupling for providing direct current isolation between said throat microphone and the preamplifier stage and between each of the successive amplifier stages and said speaker.

6. The voice communication system of claim 1, wherein:

said throat microphone comprises a miniature sound pressure transducer mounted within a housing structure defining a tympanic enclosure bounded by thin walled flat end surfaces, said transducer being mounted within said enclosure on one of said flat end surfaces to inhibit its vibration due to external ambient noise and with the other flat end surface being disposed to contact the user's throat in the vicinity of the voice box, and adjustable strap means for holding said throat microphone in place with said other end wall against the user's throat.

7. An improved voice communication system with an audio amplifier for driving a speaker to reproduce voice sounds from audio signals generated by a throat microphone, said amplifier comprising:

multiple amplifier stages having capacitive coupling to said throat microphone and between successive stages, said stages including a preamplifier stage, an intermediate stage and a power output stage for driving said speaker, said intermediate stage having an adjustable phase shift compensation network for varying the relative phase between the low frequency components of the audio signal from said throat microphone.

8. The improved voice communication system of claim 7 wherein:

said adjustable phase shift compensation network consists of a variable reactive negative feedback network coupled between the output of said intermediate amplifier stage and its input.

9. The improved voice communication system of claim 8, wherein:

said variable feedback network comprises an inductive element coupled in series between the input and output of said intermediate amplifier stage, and a variable capacitive reactance network coupled to receive the negative feedback signal passed by said inductive element to selectively attenuate the higher frequency components applied to the input of said intermediate amplifier stage, whereby said inductive element and said capacitive network are coupled in series as a low pass filter with a variable Q to selectively vary the phase shift between the lower frequency audio components and reduce the negative feedback level of higher frequency audio components to increase their amplification.

10. The improved voice communication system of claim 9 wherein:

said variable capacitive network comprises a fixed capacitor coupled in series with a variable resistance element whereby the variable resistance is reduced to decrease the amplitude of the negative feedback for the higher frequency audio components thereby increasing their amplification at the output relative to said lower frequency components.

11. An improved voice communication system with an audio audio amplifier for driving a speaker to reproduce voice sounds from audio signals generated by a throat microphone, said throat microphone comprising:

a miniature dynamic pressure transducer; a microphone housing defining a tympanic enclosure having cylindrical side walls and opposing thin flat end walls, said transducer being mounted on one of said end walls within said enclosure with the other of said end walls being free to vibrate in response to audio frequency vibrations in contact with a user's throat adjacent the voice box to produce pressure variations within said enclosure; and an electrical connector coupling the output of said transducer to said audio amplifier through an airtight seal in said one end wall adjacent said transducer.

12. The improved voice communication system of claim 11 wherein:

said microphone housing comprises first and second thin wall plastic half sections each having a central concave cylindrical depression surrounded by an elliptical flange, said flange portions being joined to form an airtight seal between said half sections wherein said concave depressions define the end and side walls of said tympanic enclosure.

* * * * *